US009325079B2

(12) United States Patent
Leem

(10) Patent No.: US 9,325,079 B2
(45) Date of Patent: Apr. 26, 2016

(54) MOBILE TERMINAL

(71) Applicant: Jihun Leem, Bucheon (KR)

(72) Inventor: Jihun Leem, Bucheon (KR)

(73) Assignee: LG Electronics Inc., Seoul (KR)

( * ) Notice: Subject to any disclaimer, the term of this patent is extended or adjusted under 35 U.S.C. 154(b) by 194 days.

(21) Appl. No.: 13/680,368

(22) Filed: Nov. 19, 2012

(65) Prior Publication Data

US 2013/0141305 A1 Jun. 6, 2013

(30) Foreign Application Priority Data

Dec. 5, 2011 (KR) ..... 10-2011-0129180

(51) Int. Cl.

| | |
|---|---|
| ***H01Q 21/28*** | (2006.01) |
| ***H01Q 21/00*** | (2006.01) |
| ***H01Q 1/24*** | (2006.01) |
| ***H01Q 1/52*** | (2006.01) |

(52) U.S. Cl.

CPC ..... *H01Q 21/28* (2013.01); *H01Q 1/243* (2013.01); *H01Q 1/521* (2013.01); *H01Q 21/00* (2013.01)

(58) Field of Classification Search

CPC ..... H01Q 21/28
USPC ..... 343/893
See application file for complete search history.

(56) References Cited

U.S. PATENT DOCUMENTS

| | | | | |
|---|---|---|---|---|
| 2009/0284440 | A1* | 11/2009 | Weidmann et al. | 343/893 |
| 2010/0265146 | A1* | 10/2010 | Montgomery et al. | 343/722 |
| 2010/0302110 | A1* | 12/2010 | Leem | 343/702 |

* cited by examiner

*Primary Examiner* — Dameon E Levi
*Assistant Examiner* — Andrea Lindgren Baltzell
(74) *Attorney, Agent, or Firm* — Ked & Associates LLP

(57) ABSTRACT

A mobile terminal includes a terminal body, a multi-layered circuit board mounted onto the terminal body and having a first ground and a second ground laminated on each other, a first antenna device connected to the first ground, and a second antenna device connected to the second ground, whereby antennas can be implemented more efficiently within a small space with maintaining performance of the antennas, resulting in size reduction of the mobile terminal.

10 Claims, 6 Drawing Sheets

MOBILE TERMINAL

CROSS-REFERENCE TO RELATED APPLICATION

Pursuant to 35 U.S.C. §119(a), this application claims the benefit of earlier filing date and right of priority to Korean Application No. 10-2011-0129180, filed on Dec. 5, 2011, the contents of which is incorporated by reference herein in its entirety.

BACKGROUND OF THE INVENTION

1. Field of the Invention

This specification relates to an antenna apparatus for transmission or reception of a wireless signal.

2. Background of the Invention

As mobile communication technologies are developed and consumers demand on more various types of services, mobile communication services have continued to evolve. The initial mobile communication has been provided, simply focusing on voice (audio) communication. However, in recent time, various mobile communication services, such as multimedia services like music or movies, wireless portable Internet capable of using the Internet at ultra high speed during travel and satellite communication services for providing mobile communication over borders are appearing.

In the meantime, as an antenna of a general mobile communication terminal is reduced in size, radiation efficiency of the antenna is lowered, a frequency band is narrowed and an antenna gain is reduced. However, size reduction, multi-functionality and high performance are continuously requested for the mobile terminal, in spite of the performance degradation. This also requires for size reduction and high performance with respect to an antenna used for a mobile communication system.

Also, as an interest in a design of a terminal increases and the terminal becomes small and light, a problem that the performance of an internal antenna is lowered as compared to an external antenna is caused. Thus, the mobile terminal is equipped with a main antenna for transmission and reception, which is installed in the terminal for improvement of performance and smooth data communication, and a separate diversity antenna for preventing a fading effect.

The diversity antenna has been developed to an antenna which can be easily installed even in a narrow space within a terminal body. Examples of the diversity antenna include a Planar Inverted F-Antenna (PIFA) having a sufficient distance more than $\lambda/2$ from the main antenna, a meander antenna having a curved pattern, a loop antenna, an inverted F-antenna, a wire type antenna and the like.

For use of the conventional external antenna, lowering of antenna performance is not exhibited by virtue of a sufficiently spaced distance from the diversity antenna. However, for use of an internal main antenna which occupies more than a predetermined area of an inner space of the terminal, an isolation less than 5 dB is acquired due to an insufficiently space distance from the diversity antenna, causing the performance of the main antenna to be lowered due to interference with each other.

Further, with the development of communication technologies applied to mobile terminals, terminals supporting a dual mode or triple mode in addition to the conventional single frequency transmission and reception function are released, and various types of applications, such as CDMA, PCS, WCDMA, GSM, GPS, WIFI, Bluetooth, Long Term Evolution (LTE), Wimax functions are implemented in one terminal. Also, the size reduction of the terminal results in installing many antennas within a narrow space.

Terminals employing diversity antennas with different frequency bands cause difficulty in ensuring an installation space and a spaced distance for the diversity antennas, and the problem caused due to the interference between the antennas becomes worse.

Consequently, an antenna apparatus which is capable of ensuring installation space and spaced distance and achieving higher efficiency may be taken into account.

SUMMARY OF THE INVENTION

Therefore, an aspect of the detailed description is to provide a mobile terminal having an antenna apparatus having a more improved performance.

Another aspect of the detailed description is to provide an antenna apparatus having satisfactory wireless performance within a smaller space, and a mobile terminal having the same.

To achieve these and other advantages and in accordance with the purpose of this specification, as embodied and broadly described herein, there is provided a mobile terminal including a terminal body, a multi-layered circuit board mounted onto the terminal body, the multi-layered circuit board having a first ground and a second ground laminated on each other, a first antenna device grounded to the first ground, and a second antenna device grounded to the second ground, wherein the multi-layered circuit board may include a first surface on which electric devices are disposed and a second surface on which the second ground is formed, and the first antenna device may be connected to the first ground via a through hole extending from the first surface down to the first ground formed between the first surface and the second surface.

In accordance with one aspect, the first antenna device may be disposed adjacent to one end of the terminal body. The second antenna device may be spaced apart from the multi-layered circuit board and disposed adjacent to another end of the terminal body.

In accordance with one aspect, the second antenna device and the multi-layered circuit board may be connected to each other via a connection portion, which extends from the second antenna device to the multi-layered circuit board.

In accordance with one aspect, the connection portion may be disposed such that at least part thereof is obscured by a power supply unit detachably coupled to the terminal body.

In accordance with one aspect, the multi-layered circuit board may include at least one dielectric layer, and the dielectric layer may be located between the first ground and the second ground.

In accordance with one aspect, the first antenna device and the second antenna device may operate as Multiple Input Multiple Output (MIMO) antennas.

In accordance with one aspect, the second surface may have a Band Stop Filter (BSF), which has a plurality of resonance members for improving an isolation characteristic between the first antenna device and the second antenna device by erasing a signal of a specific frequency band.

In accordance with one aspect, an antenna gain difference between the first antenna device and the second antenna device may be in the range of 3 to 6 dB.

In accordance with one aspect, an antenna to antenna isolation between the first antenna device and the second antenna device may be at least 8 dB.

In accordance with one aspect, an Envelope Correlation Coefficient (ECC) between the first antenna device and the second antenna device may be within 0.5.

In a mobile terminal according to at least one exemplary embodiment with the configuration, antennas can be implemented more efficiently within a small space with maintaining performance of the antennas, resulting in size reduction of the mobile terminal.

Also, a plurality of grounds may be provided and each ground may be spatially isolated, so as to improve an isolation characteristic between a first antenna device and a second antenna device. This may result in acquisition of MIMO ECC within 0.5 even if the first antenna device is spaced apart from the second antenna device within a predetermined distance.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of a mobile terminal according to the exemplary embodiments, with reference to the accompanying drawings. Hereinafter, suffixes "module" and "unit or portion" for components used herein in description are merely provided only for facilitation of preparing this specification, and thus they are not granted a specific meaning or function. Hence, it should be noticed that "module" and "unit or portion" can be used together.

Mobile terminals may be implemented using a variety of different types of terminals. Examples of such terminals include mobile terminals, such as mobile phones, smart phones, notebook computers, digital broadcast terminals, Personal Digital Assistants (PDA), Portable Multimedia Players (PMP), navigators and the like, and stationary terminals, such as digital TVs, desktop computers and the like.

Figure 1:
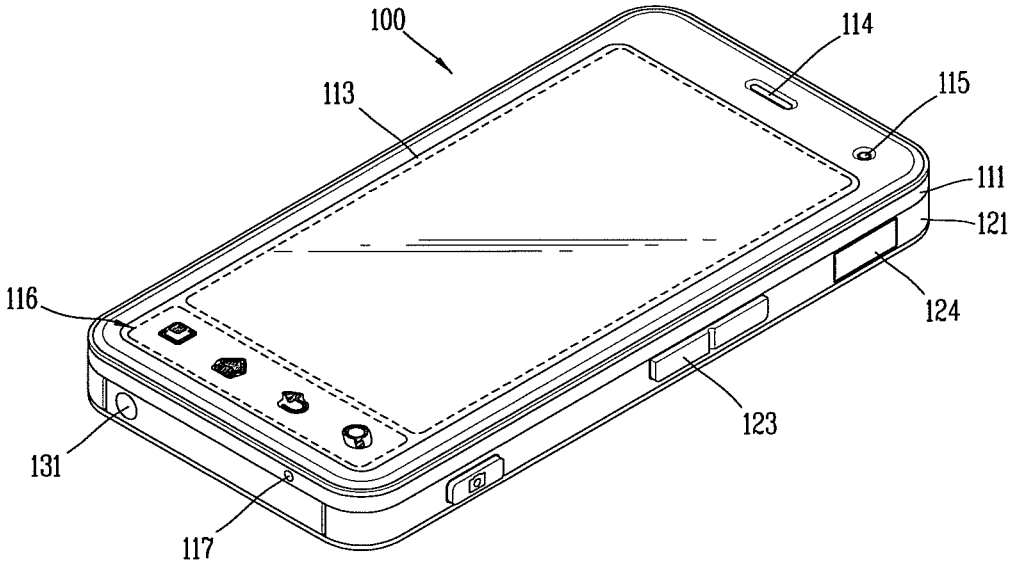
FIG. 1 is a front perspective view of a mobile terminal in accordance with one exemplary embodiment.

FIG. 1 is a perspective view of a mobile terminal 100 in accordance with one exemplary embodiment.

A case (casing, housing, cover, etc.) forming an outer appearance of the main body of the mobile terminal 100 may be formed from a front case 111 and a rear case 121. A space formed by the front case 111 and the rear case 121 may accommodate various electronic components therein. At least one intermediate case may further be disposed between the front case 111 and the rear case 121. Such cases may be formed by injection-molded synthetic resin, or may be formed using a metallic material such as stainless steel (STS) or titanium (Ti).

The front case 111 is shown having a display unit 113, a first audio output module 114, a first image input unit 115, a first manipulation unit 116, an audio input unit 117 and the like.

The display unit 113 may include a display module 200 (see FIG. 3), such as a Liquid Crystal Display (LCD) module, an Organic Light-Emitting Diode (OLED) module and the like to display visible information. The display unit 113 may be implemented as a touch screen so as to allow inputting of information by a user's touch.

The first audio output module 114 may include a receiver, a speaker or the like.

The first image input unit 115 may be a camera module for capturing images or video of the user and the like.

The first manipulation unit 116 may be manipulated to allow inputting of commands for controlling operations of the mobile terminal 100. The first manipulation unit 116 may be a key region formed to be sensitive to a touch input by a user on a window.

The audio input unit 117 may be implemented, for example, as a type of microphone for receiving voice or other sounds input by the user.

The rear case 121 of the mobile terminal 100 may further be provided with a second manipulation unit 123, an interface unit 124, a power supply unit 125 and the like.

The second manipulation unit 123 may be installed at a side surface of the rear case 112. The first and manipulation units 116 and 123 may be referred to as a manipulating portion. Such manipulating portion can employ any tactile manner that a user can touch or tap for manipulation. For instance, the manipulating portion may be implemented as a dome switch, a touchpad or the like by which a user can input commands or information in a pushing or touching manner. Alternatively, the manipulating portion may be implemented as a wheel or a jog which rotates keys or a joystick.

From the functional perspective, the first manipulation unit 116 is configured to input commands such as START, END or the like, and the second manipulation unit 123 can be worked as a hot key which performs a specific function, such as activating of the first image input unit 115, as well as a scroll function. Upon employing at least the first and second manipulation units 116 and 123, inputting of telephone numbers or text messages may be executed using a touch screen disposed on the display unit 113.

The interface unit 124 may serve as a path for allowing data exchange between the mobile terminal and an external device. For example, the interface unit 124 may be at least one of wired/wireless earphone ports, ports for short-range communication (e.g., IrDA, Bluetooth, WLAN, etc.), power supply terminals for power supply to the mobile terminal and the like. The interface unit 124 may be a card socket for coupling to external cards, such as a Subscriber Identity Module (SIM), a User Identity Module (UIM), a memory card for storage of information and the like.

The power supply unit 125 may be provided at the rear case 121 to supply power to at least one component of the mobile terminal 100. The power supply unit 125, for example, may include a rechargeable battery for power supply.

Figure 2:
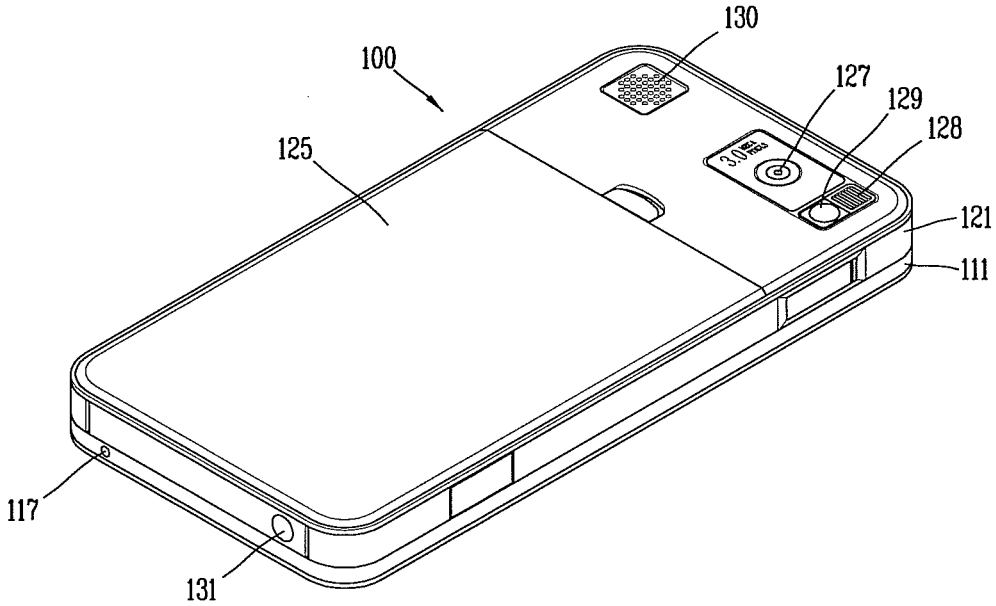
FIG. 2 is a rear perspective view of the mobile terminal.

FIG. 2 is a rear perspective view of the mobile terminal 100 shown in FIG. 1.

Referring to FIG. 2, the rear case 112 is shown having a second image input unit 127, a second audio output module 130, a broadcast signal receiving antenna 131 and the like.

The second image input unit 127 faces a direction which is opposite to a direction faced by the first image input unit 115 (see FIG. 1), and may have different pixels from those of the first image input unit 115. For example, the first image input unit 115 may operate with relatively lower pixels (lower resolution). Thus, the first image input unit 115 may be useful when a user can capture his face and send it to another party during a video call or the like. On the other hand, the second image input unit 127 may operate with relatively higher pixels (higher resolution) such that it can be useful for a user to obtain higher quality pictures for later use.

A flash 128 and a mirror 129 may additionally be disposed adjacent to the second image input unit 127. The flash 129 operates in conjunction with the second image input unit 128 when taking a picture using the second image input unit 127. The mirror 129 can cooperate with the second image input unit 127 to allow a user to photograph himself in a self-portrait mode.

The second audio output module 130 can cooperate with the first audio output module 114 (see FIG. 1) to provide stereo output. Also, the audio output module 130 may be configured to operate as a speakerphone.

A broadcast signal receiving antenna 131 may be disposed at one side of the rear case 121 in addition to an antenna for communications. The antenna 131 may be drawn out of the rear case 121.

As described above, it has been described that the first manipulation unit 116 or the like is disposed at the front case 111 and the second manipulation unit 123 or the like is disposed at the rear case 121; however, the present disclosure may not be limited to the configuration. For example, the second manipulation unit 123 may be disposed at the front case 111 in the vicinity of the first manipulation unit 116. In addition, without the second image input unit 127, the first image input unit 115 can be implemented to be rotatable so as to rotate up to a direction which the second image input unit 127 faces.

Figure 3:
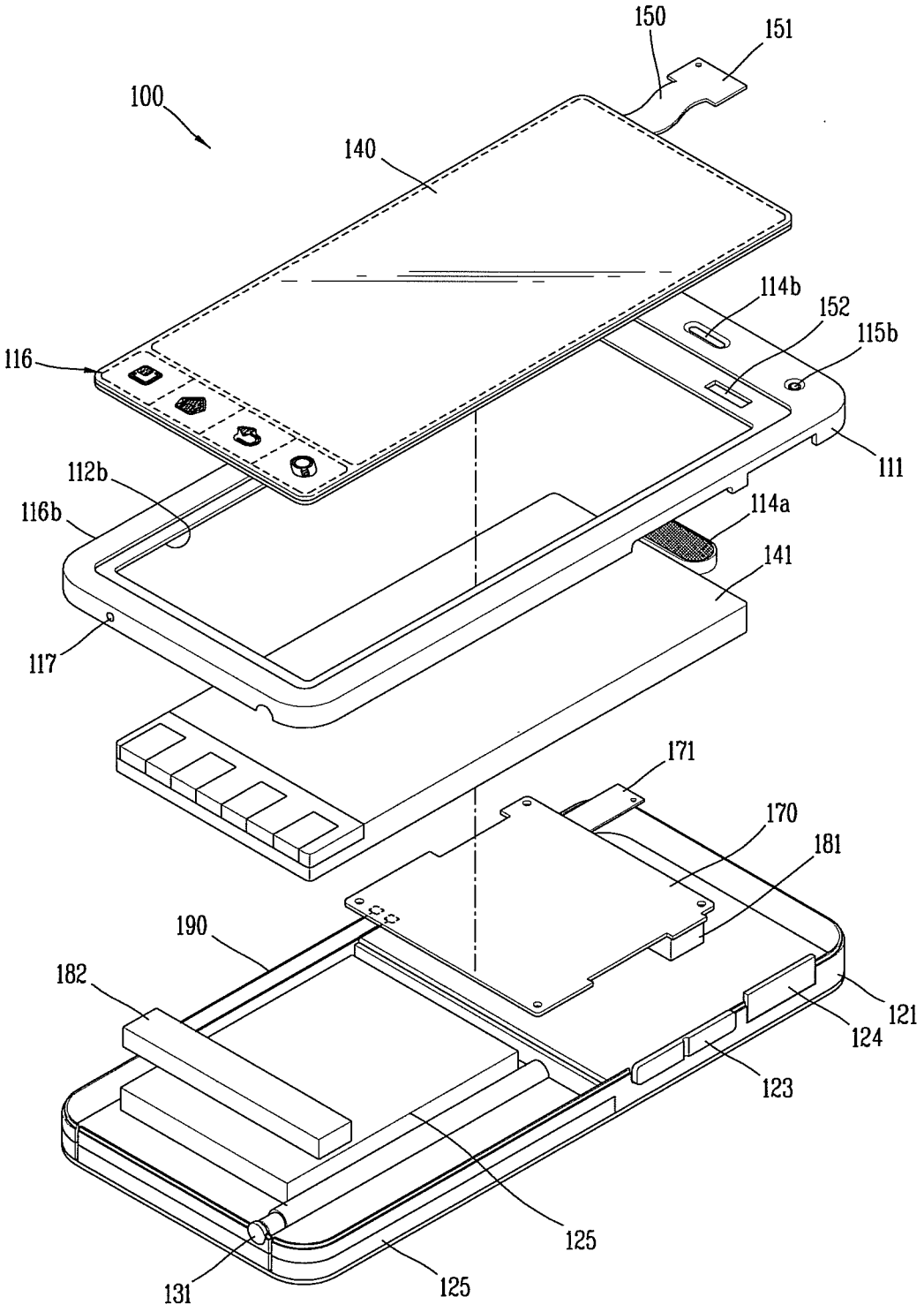
FIG. 3 is a disassembled perspective view of the mobile terminal shown in FIG. 1.

FIG. 3 is a disassembled perspective view of the mobile terminal shown in FIG. 1.

As shown in FIG. 3, a window 140 may be coupled to obscure one surface of the front case 111. The window 140 may obscure a display module 200 such that visible information output on the display module 200 can be recognized from the exterior. The display module 200 and the window 140 may configure the display unit 113 (see FIG. 1).

The window 140 may be allowed for recognition of user's touch input and for inputting of information (commends, signals, etc.).

The window 140 may have an area corresponding to the display module 200. The window 140 may be formed of a transparent material. The window 140 may have a completely opaque area or an area with extremely low light transmittance. For example, edges of the window 140 may be surface-processed such that light cannot be transmitted therethrough.

The front case 111 may be provided with a manipulation pad corresponding to the first manipulation unit 116 (see FIG. 1). The manipulation pad is a target to be touched or pressed by a user. The manipulation pad may also be formed as a manipulation area at a portion of the window 140.

The front case 111 may include a sound hole 114*b*, a window hole 112*b* and an image window.

The sound hole 114*b* may be formed to correspond to the audio output module 114, such that sounds of the mobile terminal, for example, ringtone, music and the like can come therethrough. The window hole 112*b* may be formed to correspond to the display unit 113. The transparent image window may be formed to correspond to the first image input unit 115 (see FIG. 1).

The rear case 121 is shown having a circuit board 170, the display module 141, a speaker module 114*a*, a camera module 115*a*, a switch and the like.

The circuit board 170 may be implemented as one example of a controller for running various functions of the mobile terminal 100. The circuit board 170 may detect an electrical change, which is generated within the window 140 due to a user's touch on the window 140, for example, a change in capacitance or the quantity of electric charge.

An electrode may be installed within the window 140. The electrode may be formed as a conductive pattern. The electrode may be charged with electric charge. When an electric conductor moves within a close distance, the quantity of charged electric charge may change accordingly. When the window is touched by an electric conductor, for example, a user's finger, the quantity of electric charge charged in the electrode may change, which is eventually the same as the change in capacitance between the finger and the electrode.

The electrode of the window 140 may be electrically connected to the controller, for example, the circuit board 170 for detecting changes in the quantity of electric charge. For the electrical connection, a flexible printed circuit board 150 may be connected to the circuit board 170 via a hole 152 (see FIG. 3). As the change in the quantity of electric charge is detected, the circuit board 170 may change a state of at least one function relating to the mobile terminal 100.

A flexible printed circuit board 150 may extend from one end of the window 140. A connecting portion 151 may be formed at one end of the flexible printed circuit board 150 to be connected to the electrode. The other end of the flexible printed circuit board 150 may be connected to the circuit board 170 via a connector. The connecting portion 151 may be formed of a metal so as to maintain preset stiffness and elasticity.

Hereinafter, a MIMO antenna technology in relation to the present disclosure will be described with reference to FIGS. 4 and 5.

MIMO is an abbreviated term of "Multiple Input Multiple Output." MIMO indicates a method of improving data transmission and reception efficiency by employing multiple transmit antennas and multiple receive antennas, turning away from the conventional method of using one transmit antenna and one receive antenna. That is, MIMO takes a technology of receiving one entire message by collecting (combining) individual data segments received via several antennas, without depending on a single antenna path for receiving the entire message.

The MIMO technology may improve data rate within a specific range and increase a system range with respect to a specific data rate. That is, the MIMO technology is the next generation mobile communication technology capable of being widely used in User Equipment (UE), relays and the like of mobile communication. This technology is receiving attention as a technology capable of overcoming a transmission rating limit of mobile communication, which is in a situation of reaching the transmission rating limit due to extension of data communication and the like.

Figure 4:
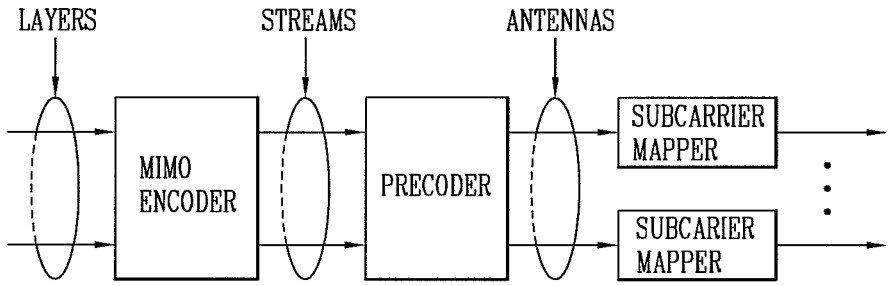
FIG. 4 is a view showing a configuration of a general multi-antenna system.

FIG. 4 is a view showing a configuration of a general multi-antenna system.

As shown in FIG. 4, when the number of antennas simultaneously increases in both transmitting and receiving ends, a theological channel transmission rating capacity may increase in proportion to the number of antennas, unlike a case of using a plurality of antennas in a transmitter or a receiver, remarkably improving frequency efficiency.

Figure 5:
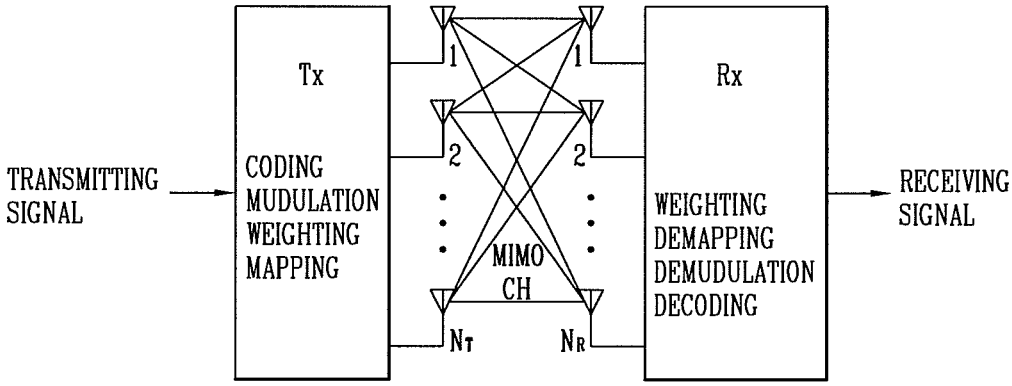
FIG. 5 is an exemplary view of a Multiple Input Multiple Output (MIMO) communication system.

FIG. 5 is an exemplary view of a Multiple Input Multiple Output (MIMO) communication system. As aforementioned, the MIMO technology refers to a technology of performing communication using multiple transmit antennas and/or multiple receive antennas. The multi-antenna technologies may be divided into a spatial diversity method of enhancing transmission reliability using symbols passed through various channel paths, and a spatial multiplexing method of improving a transmission rating by simultaneously transmitting a plurality of data symbols using a plurality of transmit antennas. Also, many studies desiring to acquire respective advantages by appropriately combining the two methods are actively conducted. Hereinafter, each method will be described in more detail.

First, the spatial diversity method may include a Space Time Block Code (STBC) based method and a Space Time Trellis Code (STTC) based method using both diversity gain and coding gain. In general, the STTC exhibits excellent performance of improving a bit error rate and a degree of freedom in code generation, whereas the STBC exhibits low computation complexity. The spatial diversity gain may correspond to an amount obtained by multiplying the number of transmit antennas by the number of receive antennas.

Second, the spatial multiplexing method is configured to transmit a different data stream via each transmit antenna. Here, interference may be caused between data transmitted from transmitters at the same time. Therefore, a receiver may detect a signal after erasing the interference through an appropriate signal processing. Examples of the interference erasing method may include a Maximum Likelihood (ML) method, a Zero Forcing (ZF) method, a Minimum Mean Square Error (MMSE) method, a Diagonal Bell Laboratories Layered Space-Time (D-BLAST) method, a Vertical Bell Labs Layered Space-Time (V-BLAST) method, and the like. When the transmitter is unable to know channel information, a Singular Value Decomposition (SVD) method may be employed.

Third, a hybrid method as combination of the spatial diversity and the spatial multiplexing may be used. When only the spatial diversity gain is obtained, a performance improvement gain in response to an increase in a diversity order is gradually saturated. Further, when only the spatial multiplexing gain is obtained, transmission reliability on a wireless channel is lowered. Examples of the hybrid method may include Double-Space Time Transmit Diversity (D-STTD), Space Time Bit-Interleaved Coded Modulation (STBICM), and the like.

First Exemplary Embodiment

Hereinafter, description will be given of an antenna operating according to the MIMO technology or the diversity method in accordance with a first exemplary embodiment, with reference to FIGS. 6 to 8.

Figure 6:
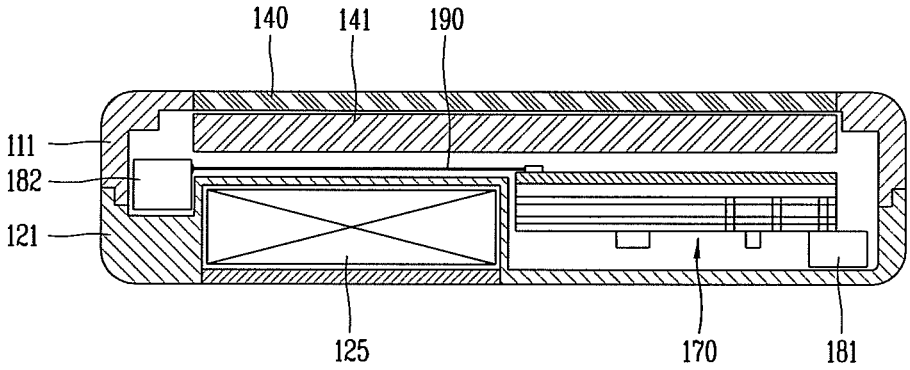
FIG. 6 is a conceptual view showing a mounted state of a multi-layered circuit board and an antenna in a terminal body in accordance with exemplary embodiments.
Figure 7:
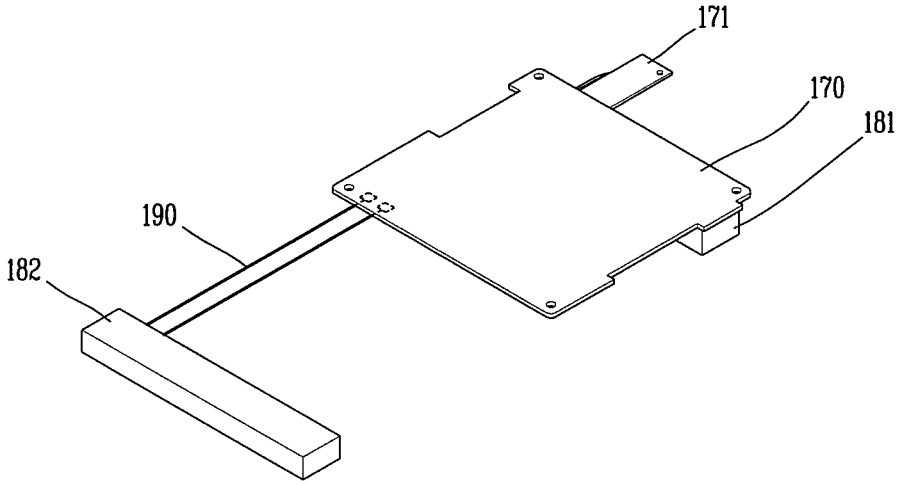
FIG. 7 is a conceptual view showing a connection between a multi-layered circuit board and an antenna in accordance with a first exemplary embodiment.
Figure 8:
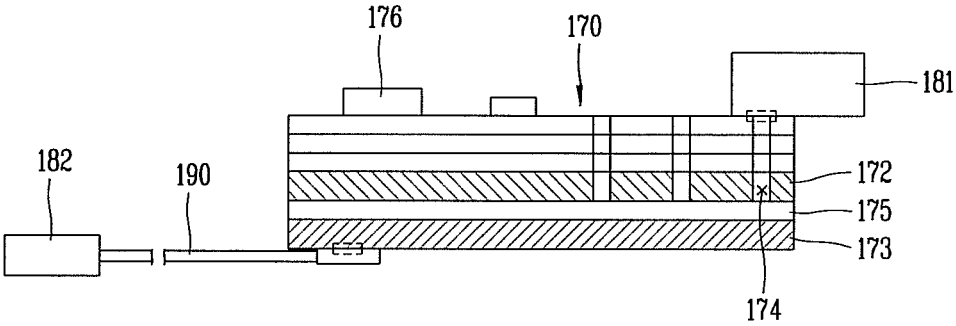
FIG. 8 is a sectional view of the circuit board shown in FIG. 7.

FIG. 6 is a conceptual view showing a mounted state of a multi-layered circuit board and an antenna in a terminal body in accordance with exemplary embodiments, FIG. 7 is a conceptual view showing a connection between a multi-layered circuit board and an antenna in accordance with a first exemplary embodiment, and FIG. 8 is a sectional view of the circuit board shown in FIG. 7.

In a system having antennas which operate according to the MIMO or diversity, in order to ensure smooth signal transmission and reception performance, a mutual coupling and an Envelope Correlation Coefficient (ECC) value has to be low between a first (primary) antenna (e.g., a main antenna for a transmitting or receiving side) and a second (secondary) antenna (e.g., a sub antenna for a receiving side in the diversity or MIMO system).

For example, the main antenna may operate as a MIMO antenna in a good state at frequencies within an LTE band when it satisfies required reception conditions, such as when it operates the same as in a case of using a single receiver, when a gain difference between two antennas is lower than 6 dB, when ECC is smaller than 0.5, when the main antenna is always used at a transmitting side, when an antenna to antenna isolation is greater than 8 dB, and the like.

Except for the basic performances of the antenna such as gain and bandwidth among the required conditions, what is the most difficult in implementing the MIMO antenna within a mobile terminal is to implement the ECC, which indicates the correlation between two antennas, to be lower than 0.5. In order to meet the condition, the two antennas have to be spaced from each other by more than a half-wave length or polarization directions of the two antennas have to be as orthogonal as possible. However, for example, LTE as the fourth generation mobile communication uses 700 MHz band. Here, the half-wave length in the band may exceed 400 mm, which may make it difficult to actually space the two antennas apart from each other by a distance more than the half-wave in the mobile terminal.

Accordingly, in the present disclosure, a plurality of grounds may be formed on a multi-layered circuit board with a spatially spaced distance therebetween, and then a first antenna and a second antenna may be grounded to different grounds, respectively.

Referring to FIGS. 7 and 8, the multi-layered circuit board 170 may be formed by laminating (stacking) a first ground 172 and a second ground 173. The multi-layered circuit board 170 may include a first surface as a upper surface and a second surface as a lower surface. The first surface is shown having various types of electric devices 176, and the second surface is shown having the second ground 173. The first ground 172 may be formed within a double-layered structure between the first surface and the second surface.

A first antenna device 181 may be grounded to the first ground 172 and a second antenna device 182 may be grounded to the second ground 173. The second antenna device 182 may serve as a main antenna and the first antenna device 181 may serve as a receiving side sub antenna in the diversity or MIMO system. Or, unlike this, the first antenna device 181 may serve as the main antenna and the second antenna device 182 may serve as the receiving side sub antenna in the diversity or MIMO system.

The first antenna device 181 may be grounded to the first ground 172 via a through hole 174 extending from the first surface to the first ground 172. The second antenna device 182 may be grounded to the second ground 173 formed on the second surface which is opposite to the first surface. Also, a dielectric layer 175 which is formed of a dielectric substance may be formed between the first ground 172 and the second ground 173.

As such, the dielectric layer 175 may spatially separate the first ground 172 and the second ground 173 from each other, to improve the isolation between the first antenna device 181 and the second antenna device 182. Even when the first antenna device 181 and the second antenna device 182 are spaced apart from each other within 200 mm, the MIMO ECC may be within 0.5.

For example, it may be noticed in such spatially separated structure that the isolation is 10.2 dB and the MIMO ECC is 0.45 even when the distance between the first antenna device 181 and the second antenna device 182 is 100 mm.

The first antenna device 181 and the second antenna device 182 may include a plurality of resonance members capable of operating within a plurality of frequency bands, and each of the resonance members may have a form, such as IFA, monopole, dipole and the like. For example, one of the resonance members may be in a form of a folded dipole and another one may be in a form of PIPA. The first antenna device 181 and the second antenna device 182 may have a feeding connection or a ground connection with respect to the multi-layered circuit board 170 according to their antenna types.

The first antenna device 181 may preferably be formed such that an antenna gain difference is in the range of 3 dB to 6 dB as compared with the second antenna device 182. This may allow for smooth signal transmission and reception in the MIMO or diversity antenna system.

The multi-layered circuit board 170 may be formed with being inclined to one side of the terminal body. The first antenna device 181 may be disposed adjacent to one end of the terminal body, and at least part of the first antenna device 181 may obscure the multi-layered circuit board 170. The second antenna device 182 may be spaced apart from the multi-layered circuit board 170 and adjacent to another end of the terminal body, so that the first antenna device 181 and the second antenna device 182 can be spatially separated from each other.

The second antenna device 182 and the multi-layered circuit board 170 which are spaced apart from each other may be electrically connected to each other via a connection portion 190. The connection portion 190 may be a coaxial cable or an FPCB.

The multi-layered circuit board 170 may be laminated on a display module, and the connection portion 190 for connecting the multi-layered circuit board 170 to the second antenna device 182 may be disposed adjacent to the display module. A battery as a power supply unit 125 may be located within a spaced space between the second antenna device 182 and the multi-layered circuit board 170. Therefore, at least part of the connection portion 190 may be obscured by the battery. The battery may be detachably coupled to the terminal body.

Second Exemplary Embodiment

Figure 9:
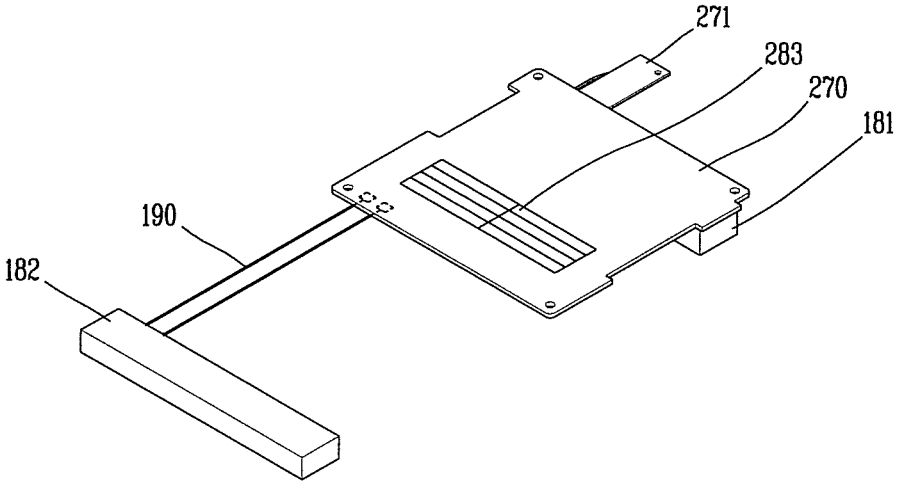
FIG. 9 is a conceptual view showing a connection between a multi-layered circuit board and an antenna in accordance with a second exemplary embodiment.
Figure 10:
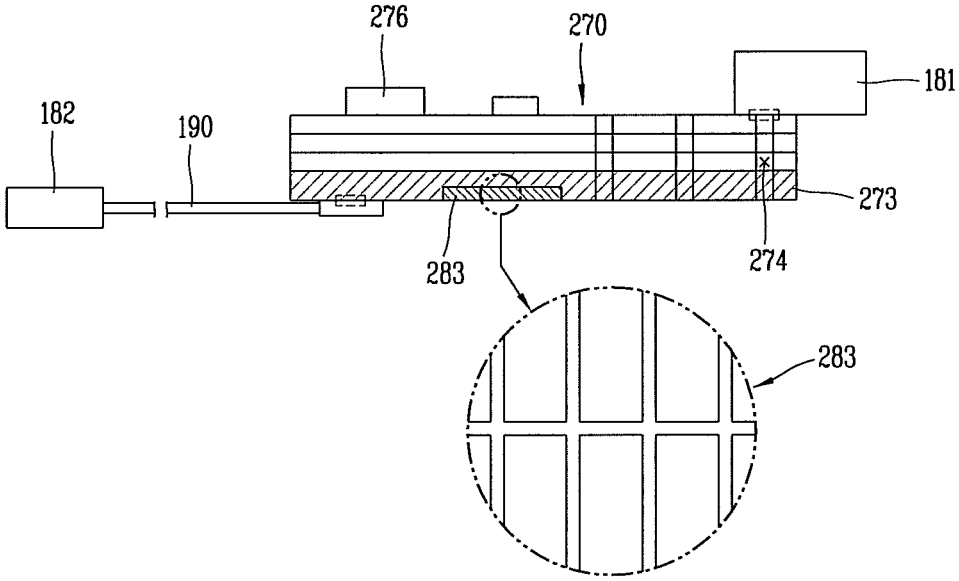
FIG. 10 is a sectional view of the circuit board shown in FIG. 9.

FIG. 9 is a conceptual view showing a connection between a multi-layered circuit board and an antenna in accordance with a second exemplary embodiment, and FIG. 10 is a sectional view of the circuit board shown in FIG. 9.

The description of the first exemplary embodiment given in relation to the first and second antennas and the connection portion will also be applied to this exemplary embodiment.

Referring to FIGS. 9 and 10, a multi-layered circuit board 270 may include one ground 273. Also, similar to the first exemplary embodiment, the multi-layered circuit board 270 may also be implemented to have one or more grounds.

The multi-layered circuit board 270 may be formed with being inclined at one side of the terminal body. The first antenna device 181 may be disposed adjacent to one end of the terminal body, and at least part of the first antenna device 181 may obscure the multi-layered circuit board 270. The second antenna 182 may be spaced apart from the multi-layered circuit board 270 and adjacent to another end of the terminal body. This may allow the first antenna device 181 and the second antenna device 182 to be spatially separated from each other.

The second antenna device 182 and the multi-layered circuit board 270 which are spaced apart from each other may be electrically connected to each other via the connection portion 190.

The multi-layered circuit board 270 may have a first surface as an upper surface and a second surface as a lower surface. The first surface is shown having various electric devices 276, and the second surface is shown having a ground.

The first antenna device 181 may be grounded to a ground 273 via a through hole 274 which extends from the first surface down to the ground 273. The second antenna device 182 may be grounded to the ground 273 formed on the second surface which is opposite to the first surface.

The multi-layered circuit board 270 may include a Band Stop Filter (BSF) 283. More concretely, the second surface of the multi-layered circuit board 270 may be shown having the BSF 283.

The BSF may stop (erase) a signal of a specific frequency band. The BSF may be configured by combination of an inductor L and a capacitor C, which are implemented as conductive patterns to have predetermined L value and C value, respectively. In general, the inductor exhibits a characteristic that a signal does not well pass through a filter as the frequency increases, and the capacitor exhibits a characteristic that a signal well passes through the filter as the frequency increases. Accordingly, a signal of a specific frequency band may be erased by deciding a resonant frequency of the BSF by combination of the inductance and the capacitance.

The BSF 283 may include a plurality of resonance members which resonate within a specific frequency band. The BSF 283 may be formed on the second surface of the multi-layered circuit board 270, to erase (block, remove) noise or unnecessary signal of the specific frequency which may be generated between the first antenna device and the second antenna device which share the ground. This may result in improvement of an antenna-to-antenna isolation characteristic.

Third Exemplary Embodiment

Figure 11:
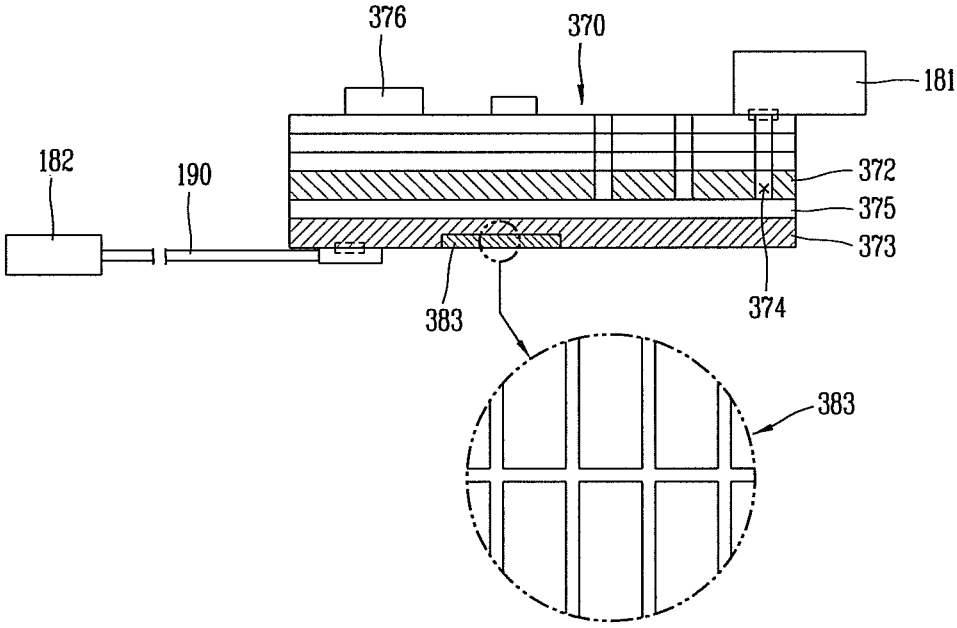
FIG. 11 is a sectional view of a circuit board in accordance with a third exemplary embodiment.

FIG. 11 is a sectional view of a circuit board in accordance with a third exemplary embodiment.

The description of the first exemplary embodiment given in relation to the first and second antennas and the connection portion will also be applied to this exemplary embodiment.

In accordance with another exemplary embodiment of the present disclosure, similar to the first exemplary embodiment, a multi-layered circuit board may include a plurality of grounds, for example, a first ground 372 and a second ground 373 which are stacked on each other. The multi-layered circuit board 370 may include a first surface as a upper surface and a second surface as a lower surface. The first surface is shown having various types of electric devices 376, and the second surface is shown having the second ground 373. The first ground 372 may be formed within a double-layered structure between the first surface and the second surface.

A first antenna device 181 may be grounded to the first ground 372 via a through hole 374 extending from the first surface to the first ground 372. A second antenna device 182 may be grounded to the second ground 373 formed on the second surface which is opposite to the first surface. Also, a dielectric layer 375 which is formed of a dielectric substance may be formed between the first ground 372 and the second ground 373.

As such, the dielectric layer 375 may spatially separate the first ground 372 and the second ground 373 from each other, to improve the isolation between the first antenna device 181 and the second antenna device 182.

To further improve the isolation characteristic, in addition to separating the plurality of grounds from each other, a BSF 383 may be formed on the second surface of the multi-layered circuit board 370. The BSF 383 may include a plurality of resonance members which resonate within a specific frequency band. The BSF 383 may be formed on the second surface of the multi-layered circuit board 370, to erase (block, remove) noise or unnecessary signal of the specific frequency which may be generated between the first ground 372 and the second ground 373. This may also improve the antenna-to-antenna isolation characteristic.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A mobile terminal comprising:

a terminal body;

a first antenna device connected with a first ground overlapped by a through hole therein without a connection portion between the first antenna device and the first ground;

a second antenna device connected with a second ground by a connection portion, and the second antenna device disposed apart from the first antenna device;

a multi-layered circuit board mounted onto the terminal body, wherein the multi-layered circuit board comprises:

a base substrate having a first surface on which electric devices and the first antenna device are disposed and a second surface;

the first ground disposed under the base substrate, and the first ground for grounding the first antenna device;

the through hole extending from the first surface of the base substrate to the first ground, and the through hole connected directly with the first antenna device such that the first antenna device is grounded to the first ground via the through hole; and the second ground formed under the first ground, and the second ground connecting the second antenna device via the connection portion for grounding the second antenna device, wherein the base substrate comprises:

a first dielectric substrate formed between the first antenna device and the first ground for spatially separating the first antenna device and the first ground; and a second dielectric substrate formed between the first ground and the second ground for spatially separating the first ground and the second ground.

2. The terminal of claim 1, wherein the first antenna device is disposed adjacent to one side surface of a space between a rear case of the terminal body and the multi-layered circuit board, and wherein the second antenna device is spaced apart from the multi-layered circuit board, and the second antenna device is disposed in the space, wherein the first antenna device is implemented with a reduced size by directly connecting with the first ground by the through hole therein such that the first antenna device can be disposed adjacent to the one side surface of the space.

3. The terminal of claim 2, wherein the connection portion is disposed such that at least part thereof is obscured by a power supply unit detachably coupled to the terminal body.

4. The terminal of claim 1, wherein the first antenna device and the second antenna device operate as Multiple Input Multiple Output (MIMO) antennas.

5. The terminal of claim 1, wherein the second surface has a Band Stop Filter (BSF), the band stop filter having a plurality of resonance members for improving an isolation characteristic between the first antenna device and the second antenna device by erasing a signal of a specific frequency band.

6. The terminal of claim 1, wherein an antenna gain difference between the first antenna device and the second antenna device is in a range of 3 to 6 dB.

7. The terminal of claim 1, wherein an antenna to antenna isolation between the first antenna device and the second antenna device is at least 8 dB.

8. The terminal of claim 1, wherein an Envelope Correlation Coefficient (ECC) between the first antenna device and the second antenna device is within 0.5.

9. The terminal of claim 1, wherein the connection portion that connects the second antenna device and the second ground is a coax cable.

10. The terminal of claim 1, wherein the connection portion that connects the second antenna device and the second ground is a flexible printed circuit board.

* * * * *